US005779439A

United States Patent [19]

Dufour

[11] Patent Number: 5,779,439

[45] Date of Patent: Jul. 14, 1998

[54] CENTRIFUGAL LIQUID PUMP WITH INTERNAL GAS INJECTION

[75] Inventor: Reneau Dufour, Breakeyville, Canada

[73] Assignee: Les Traitements des Eaux Poseïdon Inc., Outremont, Canada

[21] Appl. No.: 837,326

[22] Filed: Apr. 11, 1997

[51] Int. Cl.[6] ..... F04D 29/38

[52] U.S. Cl. ..... 415/115

[58] Field of Search ..... 415/115, 116, 415/117, 110, 111, 112

[56] References Cited

U.S. PATENT DOCUMENTS

| | | | |
|---|---|---|---|
| 2,278,397 | 3/1942 | Scheibe et al. | 415/115 |
| 2,305,226 | 12/1942 | Stalker | 415/115 |
| 4,416,581 | 11/1983 | Geary, Jr. | 415/115 |
| 4,478,553 | 10/1984 | Leibowitz et al. | 415/115 |
| 4,744,722 | 5/1988 | Sampl et al. | 415/121 B |
| 4,981,413 | 1/1991 | Elonen et al. | 415/115 |
| 5,385,443 | 1/1995 | Dufour | 415/115 |

FOREIGN PATENT DOCUMENTS

| | | | |
|---|---|---|---|
| 853227 | 11/1939 | France . | |
| 1467254 | 3/1989 | U.S.S.R. | 415/115 |

*Primary Examiner*—John T. Kwon
*Attorney, Agent, or Firm*—Robic

[57] ABSTRACT

The centrifugal liquid pump is of the rotary discs types and has an integrated gas injector of very single yet efficient structure. This pump has a casing defining an inner, substantially cylindrical chamber with an axial liquid inlet and a tangential liquid outlet. A rotary impeller is rotatably mounted within the chamber. This impeller has first and second spaced apart discs which are rigidly interconnected at such a distance away from each other as to extend close to the opposite walls of the chamber. The first disc that extends close to the wall into which the liquid inlet opens has a central opening of the same diameter as the liquid inlet to allow the liquid injected through the inlet to enter within the chamber in between the discs. The second disc has a plurality of spaced apart openings located at a constant radius, which is inferior to the radius of the discs. A coaxial power shaft is connected to the impeller so as to rotate it in a given direction. This shaft extends out of the chamber in a direction opposite to the liquid inlet. A gas feed pipe is in open communication with the chamber. This gas feed pipe is connected to a hole made in the casing. This hole is located in the second opposite wall of the chamber at a radial distance substantially equal to the above mentioned constant radius. In use, the pressurized gas fed through the hole made in second opposite wall of the casing passes through the openings made in the second disc and enters into the chamber. The gas is then disolved in the liquid while the same moves between the discs toward the outlet of the pump.

18 Claims, 4 Drawing Sheets

CENTRIFUGAL LIQUID PUMP WITH INTERNAL GAS INJECTION

BACKGROUND OF THE INVENTION a) Field of the Invention

The present invention relates to a centrifugal pump of the rotary disc type, which incorporates means for injecting and dissolving a gas, such as air, into a liquid that is preferably water, while this liquid is being pumped.

b) Brief Description of the Prior Art

In the floatation processes that are presently used for "clarifying" or otherwise treating waste water, it is of common practice to recycle part of the clarified water. Usually, the clarified water is pumped at the bottom of the floatation tank of the clarifier or at the outlet of the same and injected into the waste water to be treated just before it enters the clarifier.

It is also of common practice to inject air into the waste water that enters the clarifier, in such a manner as to generate a multitude of very small bubbles which "catch" the solids in suspension in the waste water and thus favorize flotation of the same. Such an injection can be made either directly into the waste water fed to the clarifier, just before it enters the same, or preferably into the clarified water that is recycled prior to its injection into the waste water. In both cases, the injection is preferably made under pressure so as to dissolve as much air as possible in the water.

In order to recycle a sufficient amount of clarified water and simultaneously allow dissolution therein of a sufficient amount of air to generate a multitude of micro bubbles of 150 μm or less as soon as the pressure is released, the pump must ideally generate a pressure of 550 to 825 $kN/m^2$ (80 to 120 psi). Of course, it must also have ideally a low energy consumption (expressed in $m^3$ per horse power).

To meet these goals, use has been made so far of centrifugal multistage pumps with bladed impellers that can build up pressure up to 1380 $kN/m^2$ (200 psi). However, these pumps have a low flow rate.

It has also been suggested to use rotary disc pumps comprising a plurality of closely spaced apart discs rotatably mounted within a casing (see for example U.S. Pat. Nos. 4,335,996; 4,514,139; 4,768,920 and 4,773,819). In this particular case, the pumping effect is obtained by frictional and shear forces developed between the rotating discs and the fluid. To improve such an effect, it has also been suggested to provide radial straight ribs on each disc (see U.S. Pat. No. 4,940,385).

Rotary disc pumps are interesting in that, thanks to their structure, they can easily handle a fluid such as waste water, which may contain solids in suspension. however, they are really effective only when the pressure to be built up is lower than 350 $kN/m^2$ (50 psi). Moreover, they are known to be energy consuming (maximum of 1 $m^3$/HP).

To provide the required dissolution of air in the recycled water (or in the waste water fed into the clarifier), it is of common practice to provide an air inlet in a venturi located upstream the pump, so as to suck air with and into the water and to compress with the same within the pump (see, for example,. Canadian patent No. 1,016,408, even if it is directed to another application).

It has also been suggested to inject air directly within the casing of the pump, either through conducts made in the blades of the impeller and openings at the outer ends of these blades (see U.S. Pat. No. 3,485,484) or through stationary pins extending in the casing of the pump, the blades of the rotor then being split at a given radial distance from their rotation axis not to interfere with the pins (see U.S. Pat. No. 4,744,722). In both of these cases, the casing is rendered complex and therefore expensive and difficult to repair.

Of interest although for a different application, French patent No. 853,227 which uses a central conduit connected to radial openings close to the axis of an impeller center to inject air and form a foam with water. In this patent, the water fed into the impeller is pressurized by a pump located upstream.

U.S. Pat. No. 5,385,443 granted to the present Applicant discloses a centrifugal liquid pump of the rotary disc type which incorporate a gas injection assembly of very single yet applicant structure, whereby up to 15% per volume of a gas such as are can be mixed with the pumped liquid. Gas injection is achieved with a gas feed pipe that enters axially into the pumps and with a plurality of gas injector pipes that project from the gas feed pipe radially and centrally between the discs of the impeller. The gas injection pipes rotate in unison with the discs of the impeller and allow gas to be injected into the water between the discs.

OBJECTS AND SUMMARY OF THE INVENTION

The object of the invention is to provide a centrifugal liquid pump of the rotary discs type having an integrated gas injector, which is very simple in structure and has a minimum number of moving parts to reduce wear.

In accordance with the invention, this object is achieved with a centrifugal pump for use to pump a liquid and to inject and dissolve, at least in part, a gas into the liquid while said liquid is being pumped, which comprises a casing defining an inner, substantially cylindrical chamber. This chamber has first and second opposite walls coaxial with each other.

A liquid inlet of given diameter is in open communication with the chamber. This inlet is coaxial with the chamber and opens into the first opposite wall thereof. A liquid outlet is also in open communication with the chamber. This outlet extends tangentially out of the chamber.

A rotary impeller is rotatably mounted within the chamber. This impeller comprises first and second spaced apart discs of a given radius that are coaxial with the first and second opposite walls of the chamber. The first and second discs are rigidly interconnected at such a distance away from each other as to extend close to the first and second opposite walls of the chamber, respectively. The first disc that extends close to the first opposite wall into which the liquid inlet opens, has a central opening of the same diameter as the liquid inlet to allow the liquid injected through the inlet to enter within the chamber between the discs. The second disc has a plurality of spaced apart openings located at a constant radius that is inferior to the radius of the first and second discs.

A power shaft is coaxial with and rigidly connected to the impeller so as to rotate the impeller in a given direction within the chamber. The power shaft passes through the second opposite wall of the casing and extends out of the chamber in a direction opposite to the liquid inlet.

Last of all, a gas feed pipe is provided. This gas feed pipe is in open communication with the chamber. It has a first end which is rigidly connected to a hole made in the casing. This hole is located in the second opposite wall of the chamber at a radial distance that is substantially equal to the above mentioned constant radius. The gas feed pipe also has a second end connected to a pressurized gas injector.

In use, the pressurized gas fed through the hole made in second opposite wall of the casing passes through the openings made in the second disc and enters into the chamber. This gas is then disolved in the liquid while the same moves between the discs toward the outlet of the pump.

In accordance with a preferred embodiment of the invention, the centrifugal pump has its power shaft sealingly held into the second opposite wall of the casing by a set of bearing defining a closed space therebetween. A cooling system inducing a liquid feed pipe and a liquid removal pipe is provided to supply liquid into the closed space and thus to cool the bearings.

In accordance with another preferred embodiment of the invention, the discs of the impeller are connected to each other by a plurality of samll rods and have opposite flat surfaces which face each other and on which a plurality ribs extend. The ribs project from the discs at such a distance as to leave a gap in between and are preferably thick, and high, volute-shaped and radially outwardly curved in a direction opposite to the direction in which the impeller is rotated. These ribs improve the efficiency of the pump, especially when the same has to "handle" liquids containing large particles in suspension.

As can be now be understood, the centrifugal liquid pump according to the invention has an integrated gas injector. This pump has a structure which is very similar to the basic structure of the conventional pumps of the rotary disc type, except for the addition of a few openings, hole and feed pipes. Thus, it can easily be incorporated to the structure of a conventional pump without any major modification to be made in the same. Since there is no new moving parts, the integration of the gas injector does not lead to additional wear.

Tests carried out by the Applicant have shown that the centrifugal pump according the invention may easily build up a pressure of 550 to 1050 $kN/m^2$ (80 to 150 psi) and allow injection and dissolution of up to 18% by volume of air into the pumped water, thereby allowing the formation of very efficient micro-bubbles of a few tenths of a micron. Moreover, the flow rate of the pump is appropriate and the energy consumption much better than expected (more than 2 $m^3$/HP).

BRIEF DESCRIPTION OF THE DRAWINGS

The invention and its advantages will be better understood upon reading the following, non-restrictive description of apreferred embodiment thereof, made with reference to the accompanying drawings in which.

DESCRIPTION OF A PREFERRED EMBODIMENT

In the following description, reference will be made exclusively to water as the liquid to be pumped, and to air as the gas to be injected into the pumped liquid. It is worth mentioning however that the invention is not restricted to the injection of air into water, especially waste or clarified water, and may actually be used to inject other gases into other liquids.

Figure 1:
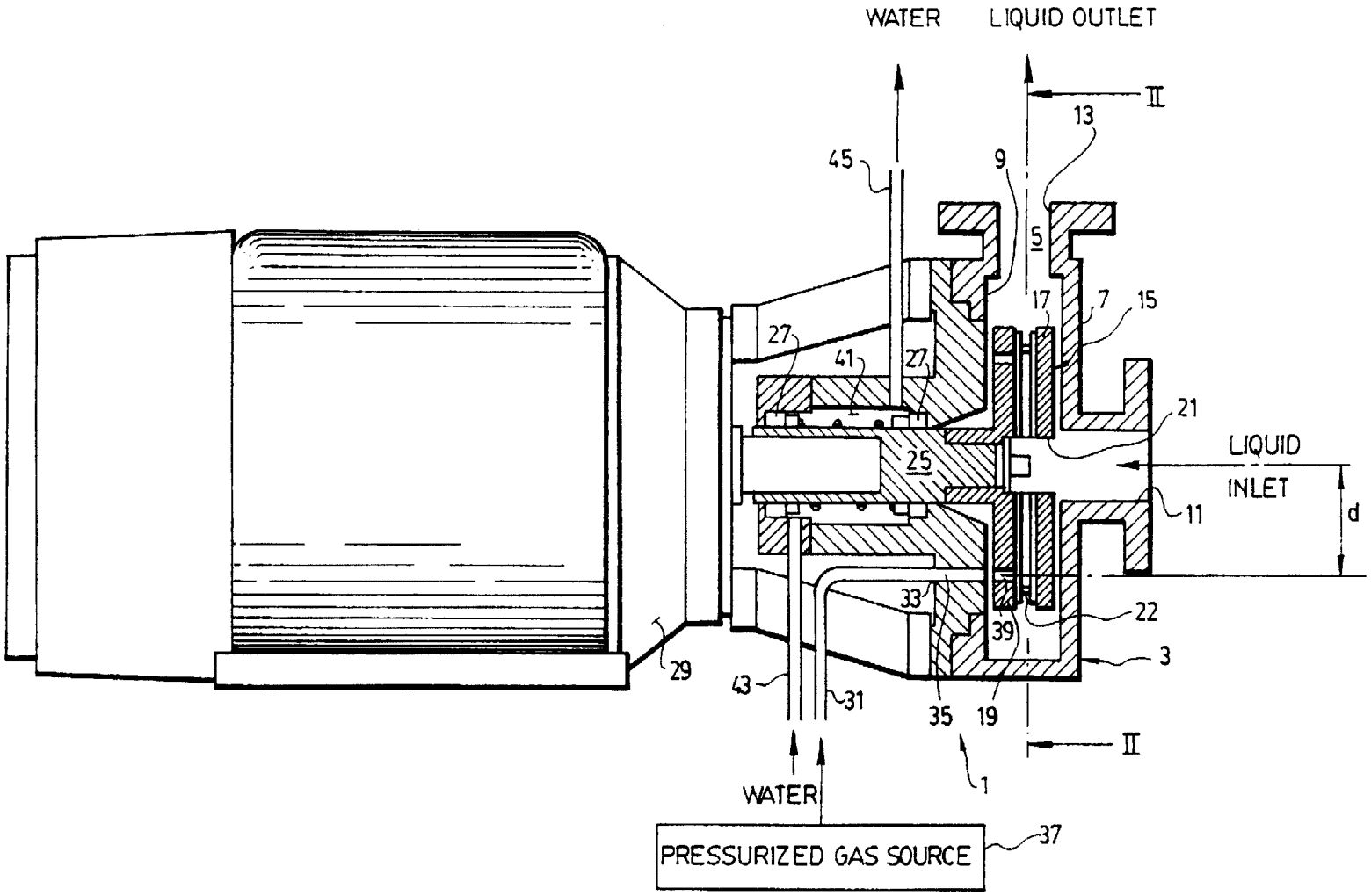
FIG. 1 is a side elevational view in partical cross-section of a centrifugal pump according to a preferred embodiment of the invention.
Figure 2:
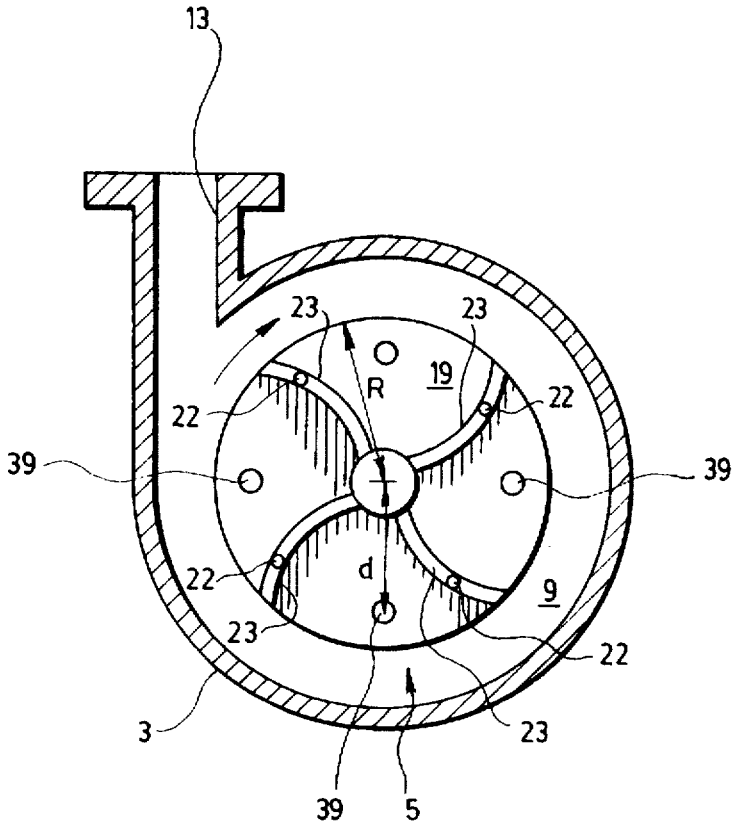
FIG. 2 is a cross-section view to have along line II–II of the pump shown in FIG. 1.

The centrifugal liquid pump 1 according to the preferred embodiment of the invention as shown in FIGS. 1 and 2 is of the "rotary disc" type. It comprises a casing 3 defining an inner, substantially cylindrical chamber 5 having a pair of opposite end walls 7, 9 coaxial with each other. The casing 3 is provided with a liquid inlet 11 that is coaxial with the chamber 5 and opens into one of the opposite end walls, e.g. the one numbered 7. The casing 3 also comprises a liquid outlet 13 that is in open communication iwht the chamber 5 and extends tangentially out of the same.

A rotary impeller 15 is rotatably mounted within the chamber 5. This impeller 15 comprises a pair of spaced apart discs 17, 19 of a given radius that are coaxial with the chamber. The discs 17, 19 are connected to each other by a plurality of small rods 22 at such a distance away from each other as to extend close to the opposite end walls, respectively. The disc that is located adjacent the opposite end wall 7 into which the liquid inlet opens, has a central opening 21 to allow the liquid injected through the inlet 11 to enter the chamber 5. Both discs 17, 19 have opposite flat surfaces which face each other and on which a plurality ribs 23 extend. As is clearly shown in FIG. 1, the ribs 23 project from the discs at such a distance as to leave a gap in between. As is better shown in FIG. 2, the ribs 23 are thick and high, volute-shaped and curved radially outwardly in a direction opposite to the direction in which the impeller is rotated, so to increase as much as possible the friction between the discs and liquid that is pumped and thus the pressure that can be built up within the pump.

The pump 1 also comprises a power shaft 25 coaxial with and rigidly connected to the second disc 19, viz. the one is opposite to the perforated disc 17. The shaft 38 is sealingly held into the wall 9 of the casing by means of a set of bearings 27. It extends out of the casing in a direction opposite to the liquid inlet 21 and it is connected to a motor 29 so as to rotate the impeller 15 within the chamber 5.

The structure of the pump 1 disclosed hereinabove is already known per se and need not be further described.

In accordance with the invention, the above pump 1 is improved in that it incorporates very simple yet efficient means for injecting and dissolving, at least in part, a gas like air, into the liquid while the same is being pumped.

Referring again to FIGS. 1 and 2, the gas injecting and dissolving means comprises a gas feed pipe 31 in open communication with the chamber 5. The gas feed pipe has a first end 33 which is rigidly connected to a hole 35 made in the casing 3. This hole 35 is located in the second opposite wall 9 of the chamber at a radial distance or radius "d" from the axis of the casing. The gas feed pipe 31 also has a second end that is located outside the casing and is connected to a pressurized gas source 37, such as an air compressor.

The gas injecting and dissolving means also comprises two or more spaced apart openings 39 that are made in the second disc 19, viz. the one adjacent the second opposite wall 9 of the casing. These openings 39 are equally spaced apart and located at a constant distance (or "radius") from the axis of the discs. This constant radius is substantially equal to the radius "d". As a result, the openings 39 pass just in front of the hole 35 when the impeller 15 rotates when the casing. Such permits to the gas fed through the hole 35 by the gas feed pipe 31 to pass through the openings 39 and enter into the chamber 5 between the discs 17, 19 at a radial distance "d" from the axis of the casing. The gas that is so fed is dissolved in the liquid while the same is being pumped.

The number of openings 39 and the radius "d" at which these openings extend may vary and actually depend on the intended use and application of the pump. The closer are the openings 39 (and the hole 35) from the axis of the pump (viz. the shorter is "d"), the lower will be the pressure required for injecting gas into the pump. The farther are the openings 39 (viz. the longer is "d"), the higher will be the pressure required for injecting air and consequently the amount of injected gas into the pump. Similarly, the higher is the number of openings 39, the better will be the distribution of gas within the liquid. However, too much openings may affect the "efficiency" of the second disc 19.

As already disclosed hereinabove, the power shaft 25 is preferably sealingly held into the wall 19 of the casing 3 by means of a set of bearing 27 that define a closed space 41 between them. A cooling system is provided to supply a continuous flow of liquid into the closed space 41 and thus cool the bearings 27. This cooling system includes a liquid feed pipe 43 and a liquid removal pipe 45 whose openings are longitudinally and radially spaced away from each other to ensure a maximum flow of liquid into the closed space 41. The liquid feed pipe 43 may be connected to the liquid outlet 13 of the pump or to any other liquid source available in the plant where is located the pump. The liquid removal pipe 45 may be provided with a check-valve to prevent backflow. It may be connected to a sewage or to the inlet 11 of the pump in order to return the cooling liquid into the main liquid stream fed to the pump.

A pump of the rotary-disc type like the one shown in FIGS. 1 and 2 was extensively tested by the Applicant for the recirculation in a clarifier of waste water (also called "white water") coming from a wet lap machine in a deinking plant. This pump was also compared with a centrifugal pump of the same size, provided with a gas injection assembly as disclosed in US Pat. No. 5,385,443.

The radius "R" of the discs of the tested pump was equal to 17.8 cm (7"). Their spacing has equal to 5.7 cm (2¼"). Each disc had ribs 22 that were 1.9 cm (¾") high. Four openings 39 were made in the second disc 19. Each opening 39 was located at a radius "d" equal to 11.4 cm (4½") from the impeller axis and had a diameter 1.08 cm (5/16"). The impeller was rotated at 3600 rpm.

Figure 3:
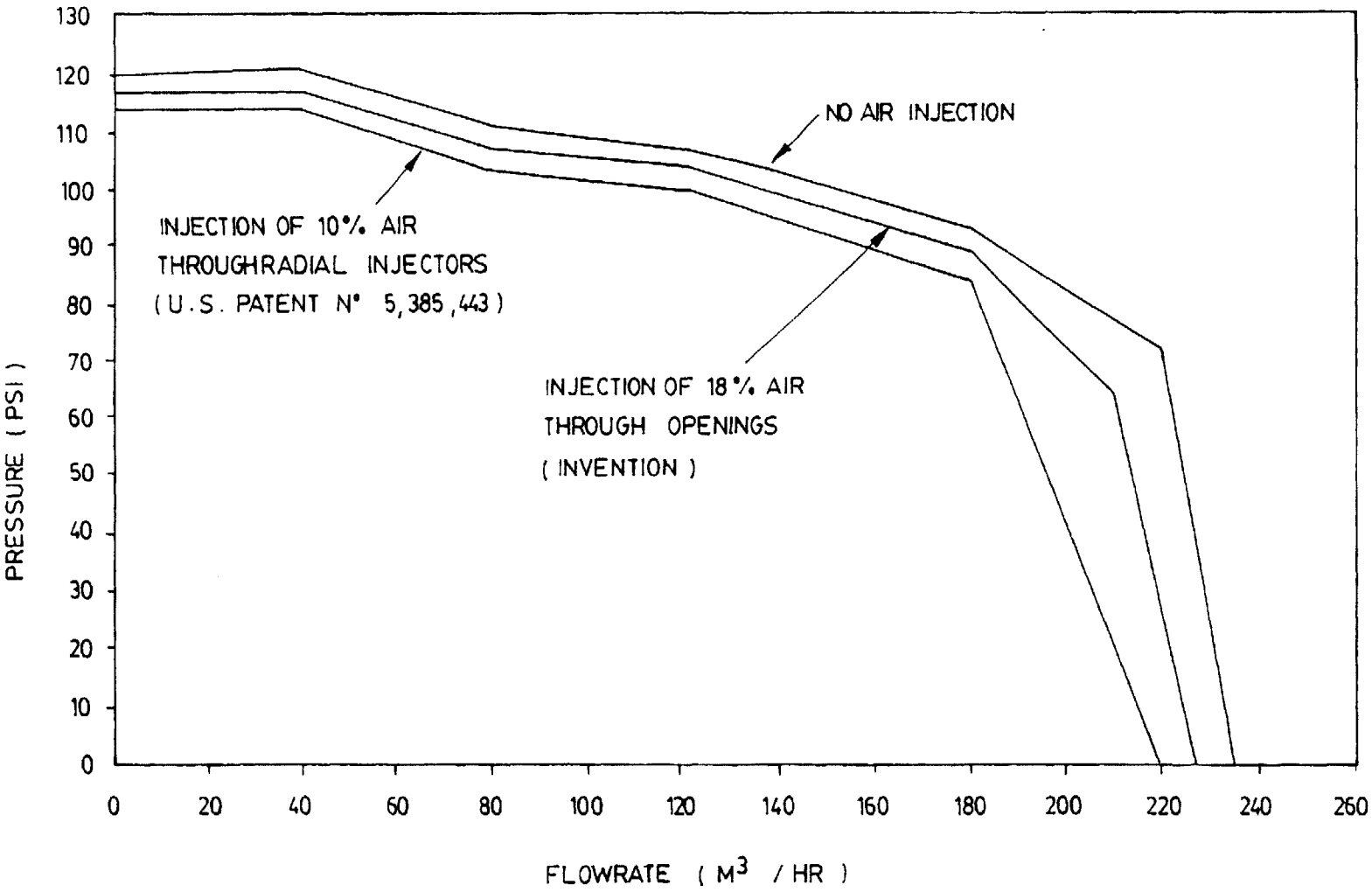
FIG. 3 is a comparative diagram giving the built up pressure as a function of the flow rate when use is made of (i) a conventional centrigugal pump with no air injection, (ii) a centrigugal pump having a plurality of gas injection pipes as disclosed in US Pat. No. 5,385,443 and (iii) a pump as shown in FIG. 1, the casing and impeller, of all these pumps being identical in shape and size.

The results that were obtained are reported in the diagram shown in FIG. 3. As can be seen, a pressure of more than 630 kN/m/2 (90 psi) was easily built up, wit a flow rate as high as 180 $m^3/h$. Moreover, up to 18% by volume of air was eaily injected into the pumped water, without unduly affecting the efficiency of the pump, using an air pressure source of $kN/m^2$ ( psi) only. The obtained results were better than those obtained with the pump of U.S. Pat. No. 5,385,443 where 10% of air was injected into the pumped water.

Comparatus tests were carried out with the same pumps on water from the same wet lap machine under the following conditions:

generated liquid pressure: 630 $kN/m^2$ (90 psi);

flow rate of injected air: 6.3 ScFM concentration of particles in suspension in the liquid fed into the machine: 180 ppm.

The concentration of particules in suspension the water recovered at he outlet of the machine were as follows:

| | PUMP ACCORDING TO U.S. PAT. NO. 5,385,443 | PUMP ACCORDING TO THE INVENTION |
|---|---|---|
| TEST 1 | 120 ppm | 100 ppm |
| TEST 2 | 122 ppm | 105 ppm |
| TEST 3 | 120 ppm | 105 ppm |
| AVERAGE | 121 ppm | 103 ppm |

Figure 4:
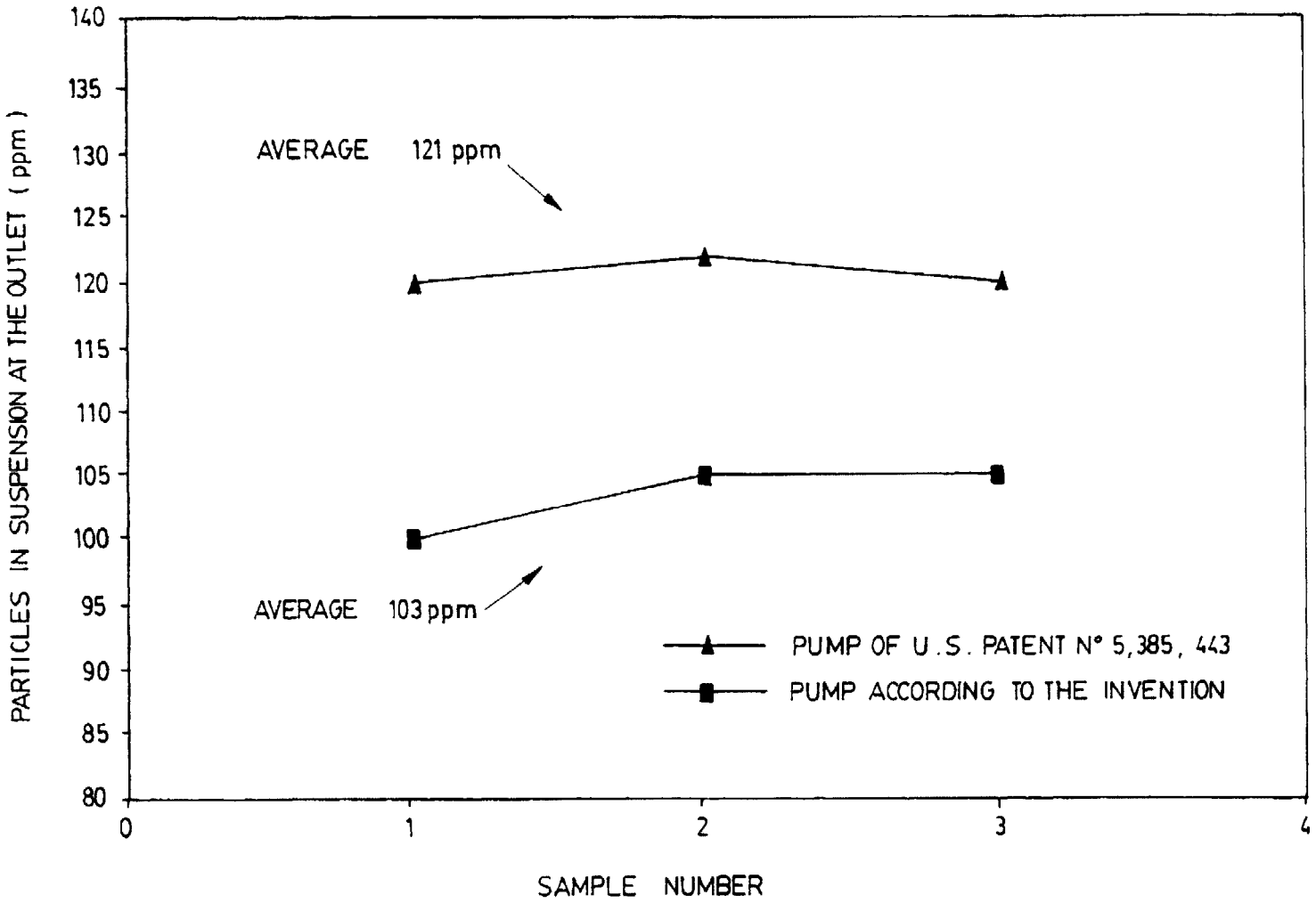
FIG. 4 is a comparative diagram giving the amount (expressed in ppm) of particules in suspension at the outlet of a same clarifier fed with (i) a centrifugal pump having a plurality of gas injection pipes as disclosed in U.S. Pat. No. 5,385,443 and (ii) a pump as shown in FIG. 1, the casing and impeller of both pumps being identical in shape and size and the operating conditions being similar in each case.

These results are reported in FIG. 4. As can be seen, a better clarification was achieved with the pump according to the invention, probably because more air was dissolved in the pumped liquid, thereby increasing the number of microbubbles for catching the particles in suspension.

Of course, numerous modifications can be made to the embodiments disclosed hereinabove without departing from the scope of the instruction as defined in the appended claims.

I claim:

1. A centrifugal pump for use to pump a liquid and to inject and dissolve, at least in part, a gas into the liquid while said liquid is being pumped, said pump comprising:

a) a casing defining an inner, substantially cylindrical chamber, said chamber having first and second opposite walls coaxial with each other;

b) a liquid inlet of given diameter in open communication with the chamber, said inlet being coaxial with said chamber and opening into the first opposite wall thereof;

c) a liquid outlet in open communication with the chamber, said outlet extending tangentially out of said chamber;

d) a rotary impeller rotatably mounted within the chamber, said impeller comprising a first and second spaced apart discs of a given radius coaxial with the first and second opposite walls of said chamber, said first and second discs being rigidly interconnected at such a distance away from each other as to extend close to the first and second opposite walls of the chamber, respectively, the first disc that extends close to the first opposite wall into which the liquid inlet opens having a central opening of the same diameter as the liquid inlet to allow the liquid injected through said inlet to enter within the chamber in between said discs, the second disc having a plurality of spaced apart openings located at a constant radius, said constant radius being inferior to the radius of said first and second discs;

e) a power shaft coaxial with and rigidly connected to the impeller so as to rotate the impeller in a given direction within the chamber, said power shaft passing through the second opposite wall of the casing and extending out of the chamber in a direction opposite to the liquid inlet; and f) a gas feed pipe in open communication with said chamber, said gas feed pipe having a first end rigidly connected to a hole made in the casing, said hole being located in the second opposite wall of the chamber at a radial distance substantially equal to said constant radius, said gas feed pipe having a second end connected to a pressurized gas injector.

2. The centrifugal pump according to claim 1, wherein the first and second discs of the impeller are connected to each other by a plurality of rods and have opposite flat surfaces which face each other and on which a plurality of ribs extends, said ribs projecting from said discs at such a distance as to leave a gap in between.

3. The centrifugal pump according to claim 2, wherein the ribs are volute-shaped and radially outwardly curved in a direction opposite to the given direction in which said impeller is rotated.

4. The centrifugal pump according to claim 1, wherein said power shaft is sealingly held into the second opposite wall of the casing by means of a set of bearings defining a closed space there between and wherein said pump further comprises:

g) a cooling system including a liquid feed pipe and a liquid removal pipe connected to said closed space so as to supply liquid thereto and thus to cool the bearings.

5. The centrifugal pump according to claim 1, wherein the openings of the second disc are equally spaced apart and are disposed so as to extend all around said second disc.

6. The centrifugal pump according to claim 5, wherein said liquid is water and said gas is air.

7. The centrifugal pump according to claim 2, wherein the openings of the second disc are equally spaced apart and are disposed so as to extend all around said second disc.

8. The centrifugal pump according to claim 7, wherein said liquid is clarified water and said gas is air.

9. The centrifugal pump according to claim 3, wherein the openings of the second disc are equally spaced apart and are disposed so as to extend all around said second disc.

10. The centrifugal pump according to claim 9, wherein said liquid is water and said gas is air.

11. The centrifugal pump according to claim 4, wherein the openings of the second disc are equally spaced apart and are disposed so as to extend all around said second disc.

12. The centrifugal pump according to claim 11, wherein said liquid is water and said gas is air.

13. The centrifugal pump according to claim 2, wherein said power shaft is sealingly held into the second opposite wall of the casing by means of a set of bearings defining a closed space there between and wherein said pump further comprises:

g) a cooling system including a liquid feed pipe and a liquid removal pipe connected to several closed space so as to supply liquid thereto and thus to cool the bearings.

14. The centrifugal pump according to claim 13, wherein the openings of the second disc are equally spaced apart and are disposed so as to extend all around said second disc.

15. The centrifugal pump according to claim 14, wherein said liquid is water and said gas is air.

16. The centrifugal pump according to claim 3, wherein said power shaft is sealingly held into the second opposite wall of the casing by means of a set of bearings defining a closed space there between and wherein said pump further comprises:

g) a cooling system including a liquid feed pipe and a liquid removal pipe connected to several closed space so as to supply liquid thereto and thus to cool the bearings.

17. The centrifugal pump according to claim 16, wherein the openings of the second disc are equally spaced apart and are disposed so as to extend all around said second disc.

18. The centrifugal pump according to claim 17, wherein said liquid is water and said gas is air.

* * * * *